United States Patent [19]

Fuk Fan

[11] Patent Number: 4,788,735

[45] Date of Patent: Dec. 6, 1988

[54] CLEANING BRUSH

[75] Inventor: Max C. Fuk Fan, Kowloon, Hong Kong

[73] Assignee: Cheong P., Chan Chan, Chaiwan, Hong Kong

[21] Appl. No.: 116,521

[22] Filed: Nov. 3, 1987

[30] Foreign Application Priority Data

May 5, 1987 [GB] United Kingdom ..... 8710607

[51] Int. Cl.[4] ..... A46B 9/10

[52] U.S. Cl. ..... 15/172

[58] Field of Search ..... 15/104 A, 144 R, 172

[56] References Cited

U.S. PATENT DOCUMENTS

| | | | |
|---|---|---|---|
| 3,421,171 | 1/1969 | Tsuruzawa | 15/172 |
| 3,619,846 | 11/1971 | Krusche et al. | 15/172 |
| 3,869,748 | 3/1975 | Krusche | 15/172 |
| 4,073,027 | 2/1978 | Tsuruzawa et al. | 15/172 |

*Primary Examiner*—Harvey C. Hornsby
*Assistant Examiner*—Corinne M. Reinckens
*Attorney, Agent, or Firm*—Freilich, Hornbaker, Rosen & Fernandez

[57] ABSTRACT

A cleaning brush comprises a brush body rotatably mounted on and biased axially towards a brush holder by a compression spring, a post non-rotatable on the brush body and projecting axially towards the brush holder, a sleeve mounted on the posts for rotation relative thereto and non-rotatable relative to the brush holder, and an actuating lever for displacing the sleeve axially away from the brush holder. The post has a circumferentially extending slot engaged by a pair of opposed inwardly projecting pins of the sleeve to provide a camming arrangement such that operation of the lever to move the sleeve axially away from the brush holder causes rotation of the brush body. The brush body is rotatable through 180° from one brushing position to another brushing position.

14 Claims, 3 Drawing Sheets

CLEANING BRUSH

The invention relates to a cleaning brush in which a brush body is rotatable on a brush holder.

It is known to provide brushes for cleaning clothing or other textiles having a brush surface comprising many short bristles all inclined in the same direction, so that when clothing is brushed dust, lint, hair and the like is picked up and retained by the bristles. This material can later be removed from the bristles by stroking them in their direction of inclination. With such brushes, in order to effect cleaning, the brush surface must always be moved in the same direction. To avoid handling difficulties for the user the brush surface is provided on a brush body which is rotatable on a brush holder connected to a handle, so that the brush surface can be rotated through 180° when it is desired to change the direction of brushing.

In one known brush a lever is provided on the handle to be operated by the user when it is desired to rotate the brush body through 180°. In this arrangement, a post projects non-rotatably from the rear of the brush body towards the brush holder and a sleeve fits round the post. When the lever is operated by the user, it engages the sleeve to move it axially along the post away from the brush holder while at the same time the sleeve is prevented from rotating by its engagement with the lever. The sleeve has an inwardly projecting pin engaging in a helical slot formed on the outer surface of the post, so that the axial movement of the sleeve causes the post to rotate through 180°, taking with it the brush body which locks into the new position.

A spring urges the sleeve towards the brush holder so that when the user releases the lever the sleeve returns to its original axial position on the post, during which return movement the sleeve rotates while the post and the brush body remain in position. In order that rotation of the sleeve is prevented during its movement away from the brush holder but permitted during the return movement, the engaging surfaces of the lever and the sleeve are specially shaped, and there is a risk that the rotatable sleeve will not always return to the correct position. Furthermore an additional spring must be provided to act on the lever to reduce the engaging pressure between it and the sleeve during the return movement.

According to the invention there is provided a cleaning brush comprising a brush body rotatably mounted on and biased axially towards a brush holder, a post non-rotatable on the brush body and projecting axially towards the brush holder, a sleeve mounted on the post for rotation relative thereto and non-rotatable relative to the brush holder, actuation means for displacing the sleeve axially away from the brush holder, the post and the sleeve being in camming engagement such that operation of the actuation means to move the sleeve axially away from the brush holder causes rotation of the brush body, and the engagement between the post and the sleeve being such that return of the sleeve towards the brush holder is permitted without rotation of the sleeve relative thereto.

In this arrangement, because the sleeve undergoes axial movement only and returns towards the brush holder without rotating it will always be in the correct position ready to be displaced by the actuation means the next time it is desired to rotate the brush body. The rotation of the brush body will generally be from one brushing position through 180° to another brushing position, and successive rotations of the brush body will normally be in the same direction.

There may be two types of brush surface at each end of the body which are selectively available by rotating the body. Preferably, however, the brush surface comprises many short bristles all inclined in the same direction.

The camming engagement between the post and the sleeve may take the form of a projection on one of these components and a camming surface on the other. Preferably a pin engages in a circumferentially extending slot. This can ensure an accurate relationship between the axial position of the sleeve and the rotational position of the post and brush body. In a preferred embodiment a pair of diametrically opposed pins on the sleeve project inwardly to engage in a circumferentially extending slot on the surface of the post, the slot having two circumferentially slanted portions each followed by a respective pin during axial movement of the sleeve away from the brush holder. Of course such a slot may alternatively be provided on the inner surface of the sleeve and the pins on the post.

The two slanted slot portions may each extend 180° and be joined to each other by a pair of diametrically opposed, axially extending slot portions, in which case the brush body will complete a 180° rotation during the displacement of the sleeve away from the brush holder. However, in a preferred embodiment, the camming engagement between the post and the sleeve is such that the brush body rotates to an intermediate position on completion of the displacement of the sleeve away from the brush holder, and the post is in camming engagement with a fixed portion of the brush holder such that when the sleeve is released by the actuation means the brush body completes its rotational movement from the intermediate position to a final position. Thus, for example, the camming engagement between the post and the sleeve may provide a 120° rotation of the brush body to the intermediate position, while a further 60° rotation may be provided by the camming engagement between the post and the brush holder fixed portion.

This latter camming engagement may conveniently take the form of cooperating elements provided on the end of the post nearest the brush holder and on the brush holder, the elements comprising respectively a pair of slanted surfaces and a pair of ribs and the elements being arranged to engage under the axial bias of the brush body towards the brush holder. Preferably the slanted surfaces are provided on the end of the post and the ribs on the brush holder, but the disposition of these elements may be reversed if desired.

The cleaning brush preferably includes means for locking the brush body in each position of use and adapted to be unlocked when the actuation means is operated by a user. There will generally be some form of locating engagement between the rim of the brush body and the brush holder, but preferably the pair of ribs referred to above are engaged during brushing in a pair of slots provided in the other cooperating element to lock the brush body against rotation. When it is desired to rotate the brush body, operation of the actuation means causes the brush body to move axially away from the brush holder until the ribs and slots disengage, thereby permitting rotation to take place. The ribs and slots can provide a positive interlock such that small inadvertent movements of the brush body away from the holder do not result in rotation of the body.

The sleeve may be provided with an external tongue which engages in an axially extending groove of the brush holder to permit axial movement of the sleeve while rotation is prevented.

For engagement with the actuating means the sleeve may be provided with an external lug. Preferably the sleeve has a pair of opposed lugs engageable by a pair of arms of the actuating means.

The actuating means may be in the form of a pivotally mounted lever arranged to be pushed by a user towards the brush holder to urge the sleeve away from the brush holder. When the lever is released, the sleeve is returned back towards the brush holder by tee axially biased brush body and ensures that the lever is also returned. Thus to obtain the desired rotation of the brush body a user simply pushes the lever which automatically returns to its original position ready to be pushed again when the body is next to be rotated. There is no need for the lever to be provided with an additional spring.

The axial bias on the brush body is preferably provided by a compression spring extending axially within the post and urging it towards the brush holder. The spring is preferably seated against bearing means provided at the free end of a central shaft secured to the brush holder and also extending axially within the post.

A preferred embodiment of the invention will now be described by way of example and with reference to the accompanying drawings, in which.

Figure 1:
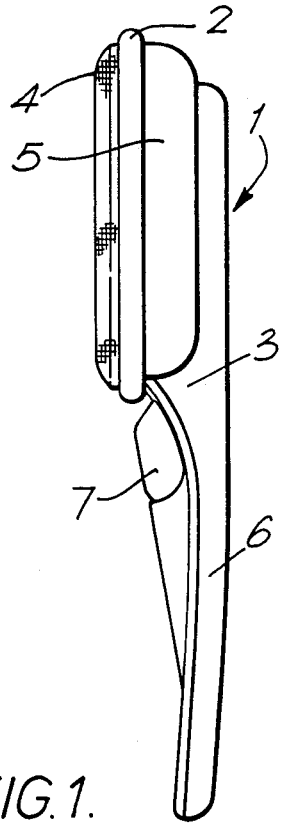
FIG. 1 is a side elevation view of a cleaning brush in accordance with the invention.
Figure 2:
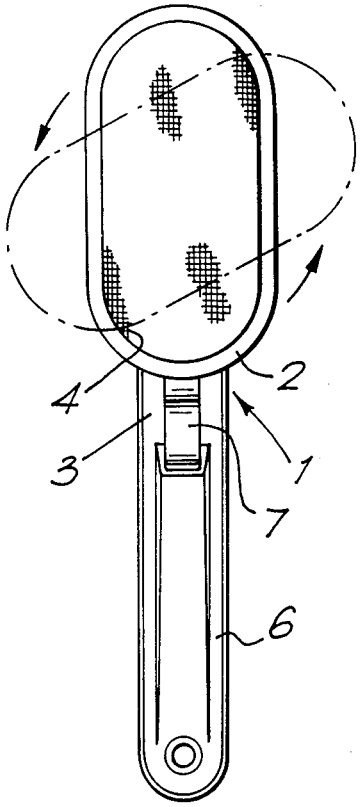
FIG. 2 is an underneath plan view of the brush.

Referring to FIGS. 1 and 2, the cleaning brush 1 comprises a brush body 2 rotatably mounted on a brush holder 3 and having a brush surface 4 in which many short bristles are all inclined in the same lateral direction. The brush holder 3 includes a front portion 5 for mounting the brush body and a rear handle 6. A knob 7 is arranged on the handle such that when it is depressed and then released by a user the brush body is caused to rotate through 180°, thereby enabling the direction of brushing to be reversed. The dotted line in FIG. 2 show an intermediate rotational position of the brush body.

Figure 3:
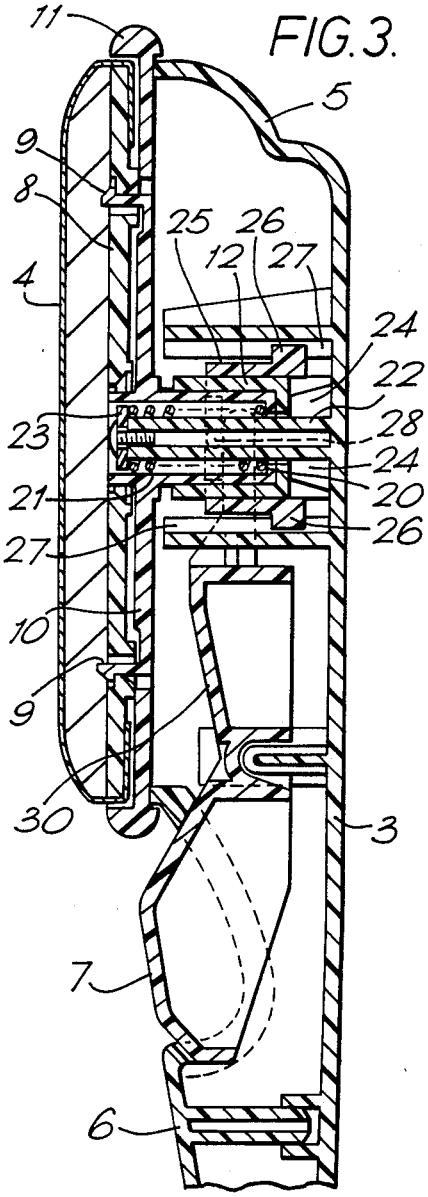
FIG. 3 is a longitudinal section through the front portion of the brush.

Referring to FIG. 3, the brush surface 4 is carried by a rigid support 8 which is secured by clips 9 to a rotatable plate 10. This plate has a peripheral rim 11 which on the front face of the plate receives the support 8 and on the rear face serves to locate the plate against the edge of the brush holder 3 in each of the two brushing positions.

Figure 7:
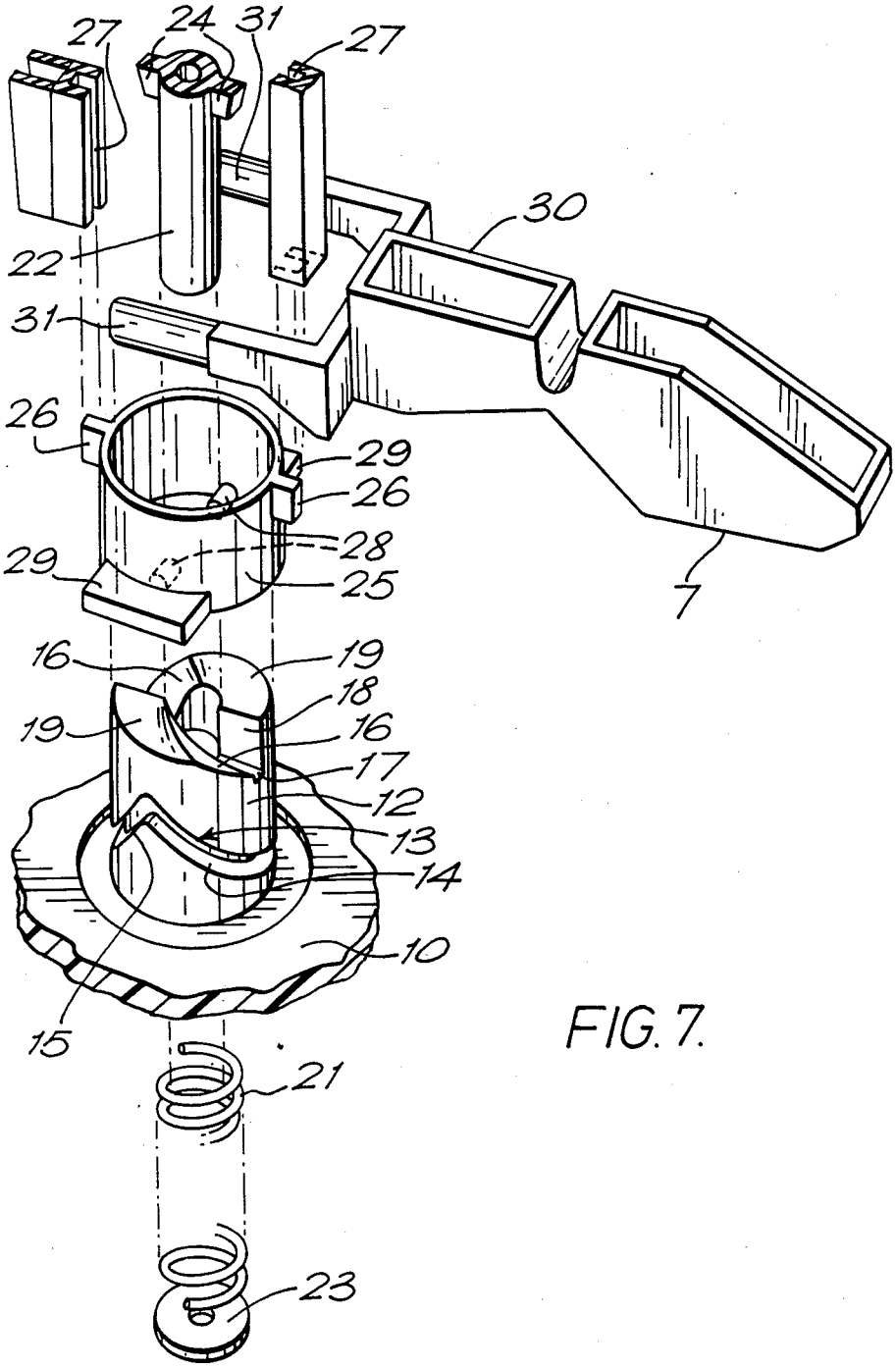
FIG. 7 is an exploded perspective view showing certain internal components of the brush.

As seen in FIGS. 3 and 7, a cylindrical post 12 projects non-rotatably from the centre of the rear face of the plate 10 towards the brush holder 3. The post 12 is formed with an external circumferentially extending slot 13 consisting of four circumferentially slanted portions. These comprise two opposed relatively long portions 14 slanted in one direction which are connected together by two opposed relatively short portions 15 slanted more steeply in the other direction.At its free end nearest the brush holder the post 12 has a profiled end face including two opposed circumferentially slanted surfaces 16 and two opposed slots 17 parallel to the axis of the post. One side of each slot is adjacent a respective slanted surface 16 while the other side comprises an abutment surface 18. The remainder of the profiled end face of the post comprises two opposed generally flat surfaces 19 perpendicular to the axis of the post and extending between the slanted surfaces and the slots.

The post 12 is axially hollow and has near its free end an internal circular shoulder 20 against which a compression spring 21 bears to urge the post, and hence the brush body 2, towards the brush holder 3. The spring is coiled round an axial shaft 22 secured to the brush holder and is seated against a washer 23 screwed to the end of the shaft. At the base of the shaft a pair of opposed ribs 24 are secured to the brush holder for locking engagement with the slots 17 of the post 12.

A sleeve 25 extends round the post 12 and has a pair of opposed external tongues 26 which engage in respective axially extending grooves 27 of the brush holder 3 so as to allow axial sliding of the sleeve but to prevent rotation thereof. The sleeve has two opposed inwardly projecting pins 28 which engage in the slot 13 of the cylindrical post 12 to provide camming engagement between the sleeve and the post. The sleeve also has a pair of external opposed lugs 29.

An actuating lever 30 is pivotally mounted on the brush holder 3 and provides on one side of the pivot the knob 7 for operation by a user. On the other side of the pivot the lever forks into a pair of arms 31 for engagement with the lugs 29 of the sleeve.

Figure 4:
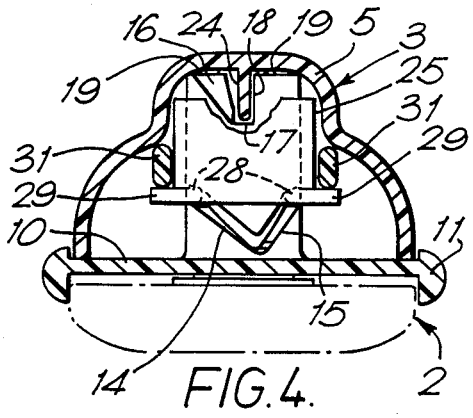
FIG. 4 is a transverse part-section of the brush in a brushing position.
Figure 5:
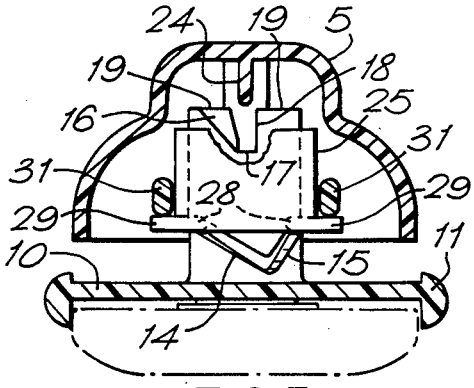
FIGS. 5 and 6 are views similar to FIG. 4 but showing two stages during rotation of the brush body from one brushing position to the other.

FIG. 4 shows the brush in either of the two brushing positions. The brush body 2 engages the brush holder 3 and is held there by the axial bias of the spring 21. When it is desired to rotate the brush body to the other brushing position, a user pushes the knob 7 towards the handle 6 so that the lever 30 pivots and the arms thereof urge the lugs 29 of the sleeve 25 away from the brush holder. Initially, any tendency of the brush body to rotate is resisted by the locking engagement of the ribs 24 in the slots 17 of the post, the ribs engaging the abutment surfaces 18. As a result, the sleeve pins 28 urge the post 12, and hence the brush body 2, axially away from the brush holder 3 without rotating until the position shown in FIG. 5 is reached.

Figure 6:
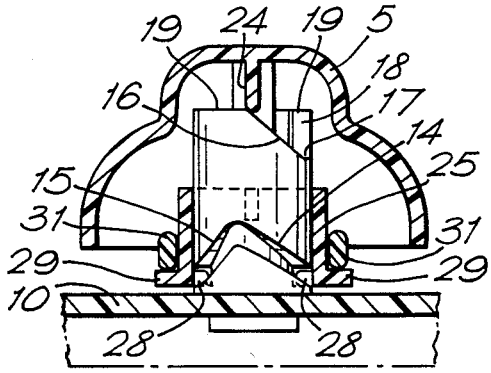

At this point the ribs 24 axially disengage from the slots 17. The post 12 tends to return towards the brush holder 3 under the axial spring force but because the long portions 14 of the slot 13 are in camming engagement with the non-rotatable sleeve pins 28, the effect is to cause rotation of the post together with the brush body. At the same time the sleeve is urged still further away from the brush holder by the arms of the lever 30, until the position shown in FIG. 6 is reached. This corresponds to the intermediate rotational position of the brush body shown in dotted lines in FIG. 2, in which the body has rotated through approximately 120°. At this stage the lever 30 and the sleeve have moved to their maximum distance from the brush holder and the sleeve pins 28 have slid along the full length of each long slanted portion 14 of the post. In addition the locking ribs 24 have been traversed by the flat end surfaces 19 of the post 12.

The user then releases the knob 7 and as the post 12 returns towards the brush holder 3 under the axial spring force there is further camming engagement between the ribs 18 and the slanted end surfaces 16 of the post. This caused a further rotation of the brush body through approximately 60° to the new brushing position which, because of the rotational symmetry of the system is also represented by FIG. 4. During the further rotation the sleeve is returned axially to its initial position by the camming engagement between its inwardly projecting pins 28 and the short slanted slot portions 15, and the return movement of the sleeve is transmitted to the lever which is thereby also returned to the initial position.

Modifications to the brush disclosed herein both in its broad aspects and in the specific embodiment, may be apparent to a person skilled in the art and it is intended that this disclosure should encompass any such modifications.

I claim:

1. A cleaning brush comprising:

a brush body having a post fixed thereto and extending substantially perpendicularly therefrom;

a brush holder;

means mounting said brush body on said brush holder for rotation with respect thereto around the axis of said post, said mounting means including means for resiliently biasing said brush body toward said brush holder;

a sleeve mounted on the post for rotation relative thereto and non-rotatable relative to the brush holder;

actuation means for displacing the sleeve axially away from the brush holder;

the post and the sleeve being in camming engagement such that operation of the actuation means to move the sleeve axially away from the brush holder causes rotation of the brush body; and the engagement between the post and the sleeve being such that return of the sleeve towards the brush holder is permitted without rotation of the sleeve relative thereto.

2. A brush as claimed in claim 1, wherein the brush body is rotatable through 180° from one brushing position to another brushing position.

3. A brush as claimed in claim 1, wherein the camming engagement between the post and the sleeve comprises a pin provided on one of these components which engages in a circumferentially extending slot in the other.

4. A brush as claimed in claim 1, wherein the camming engagement between the post and the sleeve is such that the brush body rotated to an intermediate position on completion of the displacement of the sleeve away from the brush holder, and the post is in camming engagement with a fixed portion of the brush holder such that when the sleeve is released by the actuation means the brush body completes its rotational movement from the intermediate position to a final position.

5. A brush as claimed in claim 4, wherein the camming engagement between the post and the brush holder fixed portion comprises cooperating elements provided on the end of the post nearest the brush holder and on the brush holder, the elements comprising respectively a pair of slanted surfaces and a pair of ribs and the elements being arranged to engage under the axial bias of the brush body towards the brush holder.

6. A brush as claimed in claim 5, wherein the pair of ribs are engaged during brushing in a pair of slots provided in the other cooperating element to lock the brush body against rotation.

7. A brush as claimed in claim 1, wherein the sleeve has an external tongue which engaged in an axially extending groove of the brush holder to permit axial movement of the sleeve while rotation is prevented.

8. A brush as claimed in claim 1, wherein the actuating means comprises a pivotally mounted lever having a pair of arms engageable with a pair of opposed external lugs of the sleeve, so that when a user pushes the lever towards the brush holder the sleeve is urged away from the brush holder.

9. A brush as claimed in claim 1, wherein the axial bias on the brush body is provided by a compression spring extending axially within the post and urging it towards the brush holder.

10. A brush as claimed in claim 1, wherein the brush body has a brush surface comprising many short bristles all inclined in the same direction.

11. A brushing device comprising:

a brush body having a post fixed thereto and extending substantially perpendicularly therefrom;

a brush holder;

means mounting said brush body on said brush holder for rotation with respect thereto around the axis of said post, said mounting means including means for resiliently biasing said brush body toward said brush holder;

a sleeve;

means mounting said sleeve for non-rotational translational displacement toward and away from said brush holder;

actuatable means for displacing said sleeve away from said brush holder;

camming means coupling said sleeve and post for rotating said post in response to said sleeve being displaced away from said brush holder; and wherein said resilient biasing means acts on said post to displace said sleeve back toward said brush holder and rotate said post relative to said sleeve.

12. The brushing device of claim 11 wherein said post is rotatable through 180 degrees.

13. The brushing device of claim 11 wherein said camming means comprises a slot in said post member for receiving a pin affixed to said sleeve.

14. The brushing device of claim 11 wherein said camming means includes means for causing said brush body to rotate to an intermediate position on completion of the displacement of said sleeve away from said brush holder, and wherein said post is in camming engagement with a fixed portion of the brush holder such that when the sleeve is released by said actuatable means, the brush body completes its rotational movement from said intermediate position to a final position.

* * * * *

UNITED STATES PATENT AND TRADEMARK OFFICE

CERTIFICATE OF CORRECTION

PATENT NO. : 4,788,735

DATED : Dec. 6, 1988

INVENTOR(S) : Max C. Fuk Fan

It is certified that error appears in the above-identified patent and that said Letters Patent is hereby corrected as shown below:

Front page, left column, after "assignee" cancel "Cheong P., Chan Chan, Chaiwan, Hong Kong" and substitute --Chan, Cheong P., Chan, Cheong W., Chan Hayakwan, T/A Sing Ka Industrial Co.--.

Signed and Sealed this

Eighth Day of August, 1989

*Attest:*

DONALD J. QUIGG

*Attesting Officer*

*Commissioner of Patents and Trademarks*